US011680689B2

(12) United States Patent
Monestier et al.

(10) Patent No.: US 11,680,689 B2
(45) Date of Patent: Jun. 20, 2023

(54) MECHANICAL INTEGRATION OF FLEXIBLE LED STRIPS

(71) Applicant: Lumileds LLC, San Jose, CA (US)

(72) Inventors: Florent Grégoire Monestier, Aachen (DE); Jürgen Mertens, Aachen (DE); Christian Kleijnen, Aachen (DE)

(73) Assignee: Lumileds LLC, San Jose, CA (US)

( * ) Notice: Subject to any disclaimer, the term of this patent is extended or adjusted under 35 U.S.C. 154(b) by 0 days.

(21) Appl. No.: 17/167,709

(22) Filed: Feb. 4, 2021

(65) Prior Publication Data

US 2021/0239280 A1 Aug. 5, 2021

(30) Foreign Application Priority Data

Feb. 4, 2020 (EP) ..... 20155269

(51) Int. Cl.

| | |
|---|---|
| ***F21S 4/24*** | (2016.01) |
| ***F21S 43/14*** | (2018.01) |
| ***F21S 43/19*** | (2018.01) |
| ***F21S 43/15*** | (2018.01) |
| ***F21Y 115/10*** | (2016.01) |

(52) U.S. Cl.

CPC ..... *F21S 4/24* (2016.01); *F21S 43/14* (2018.01); *F21S 43/15* (2018.01); *F21S 43/19* (2018.01); *F21Y 2115/10* (2016.08)

(58) Field of Classification Search

CPC ..... B60Q 2500/10; B60Q 3/78; B60Q 3/54; F21S 4/20; F21S 4/22; F21S 4/24; F21S 4/26; G02B 6/0005; G02B 6/0006; G02B 6/0008; G02B 6/001

See application file for complete search history.

(56) References Cited

U.S. PATENT DOCUMENTS

| | | | | |
|---|---|---|---|---|
| 4,972,303 A | | 11/1990 | Machida et al. | |
| D378,857 S | * | 4/1997 | Hale | D25/164 |
| D541,952 S | * | 5/2007 | Keeley | D25/119 |

(Continued)

FOREIGN PATENT DOCUMENTS

| | | |
|---|---|---|
| CN | 209511752 | 10/2019 |
| JP | 2016-066449 | 4/2016 |

OTHER PUBLICATIONS

Extended European Search Report dated Jul. 1, 2020 for European Patent Application No. 20155269.2.

*Primary Examiner* — Eric T Eide
(74) *Attorney, Agent, or Firm* — Volpe Koenig

(57) ABSTRACT

A lighting device includes a flexible housing, at least two light emitting elements, and at least one mounting member. The flexible housing extends along a length direction of the lighting device and has an inner surface configured to reflect light. The at least two light emitting elements are arranged along the length direction of the lighting device and are mounted to the flexible housing. The at least one mounting member is an integral component of the flexible housing and extends continuously along the length direction of the lighting device. The at least one mounting member includes a base section and a sequence of mounting sections. At least two of the mounting sections are separated from each other by a recess. The sequence of mounting sections extends from the base section of the at least one mounting member.

17 Claims, 9 Drawing Sheets

(56) References Cited

U.S. PATENT DOCUMENTS

| | | | | |
|---|---|---|---|---|
| 7,908,792 | B2 * | 3/2011 | Heighton | F21V 33/006 47/33 |
| 2005/0213342 | A1 * | 9/2005 | Tufte | G09F 13/22 362/581 |
| 2012/0147610 | A1 | 6/2012 | Ransvi | |
| 2014/0313722 | A1 * | 10/2014 | Eloff | F21S 4/22 362/418 |
| 2015/0330584 | A1 | 11/2015 | Bobbo et al. | |
| 2016/0377783 | A1 * | 12/2016 | Tanahashi | F21S 8/04 362/581 |
| 2018/0306413 | A1 * | 10/2018 | Tremaine | F21V 31/04 |
| 2019/0001875 | A1 * | 1/2019 | Xu | B60Q 3/208 |

* cited by examiner

MECHANICAL INTEGRATION OF FLEXIBLE LED STRIPS

CROSS REFERENCE TO RELATED APPLICATIONS

This application claims the benefit of European Patent Appln. No. 20155269.2, filed Feb. 4, 2020, the contents of which are hereby incorporated by reference herein.

FIELD OF INVENTION

The present application relates to a lighting device, in particular to a flexible LED strip, a lighting arrangement comprising the lighting device and a method of manufacturing the lighting device.

BACKGROUND

Flexible light emitting diode (LED) strips have become popular for exterior and interior automotive lighting applications as their flexibility allows mounting the strips, for example, in line with curved surfaces of a car body part or in line with curved boundaries of lamp bezels. In addition, use of such LED strips may enable lighting of various colors, dynamic animation and pleasant uniform appearance. Thereby, flexible LED strips may be employed for displaying information or as decorative elements emphasizing exterior and/or interior areas of a car interior and/or exterior. In the future, such flexible LED strips may become in particular advantageous for applications in combination with autonomous and/or electrical vehicles.

SUMMARY

A lighting device includes a flexible housing, at least two light emitting elements, and at least one mounting member. The flexible housing extends along a length direction of the lighting device and has an inner surface configured to reflect light. The at least two light emitting elements are arranged along the length direction of the lighting device and are mounted to the flexible housing. The at least one mounting member is an integral component of the flexible housing and extends continuously along the length direction of the lighting device. The at least one mounting member includes a base section and a sequence of mounting sections. At least two of the mounting sections are separated from each other by a recess. The sequence of mounting sections extends from the base section of the at least one mounting member.

BRIEF DESCRIPTION OF THE DRAWINGS

A more detailed understanding can be had from the following description, given by way of example in conjunction with the accompanying drawings wherein.

DETAILED DESCRIPTION

Figure 1A:
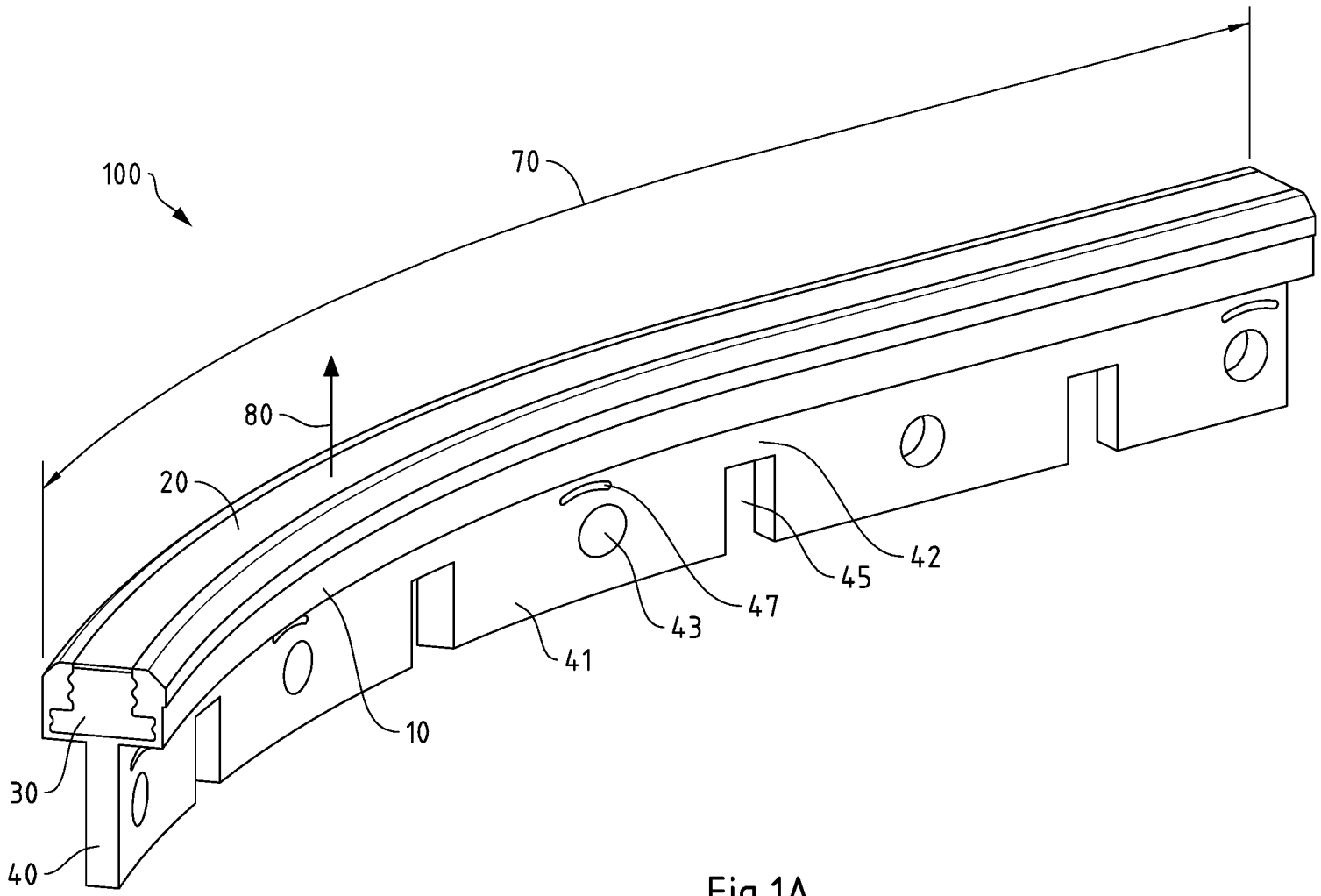
FIG. 1A is a perspective view of an example light emitting diode (LED) lighting strip.

Examples of different light illumination systems and/or light emitting diode ("LED") implementations will be described more fully hereinafter with reference to the accompanying drawings. These examples are not mutually exclusive, and features found in one example may be combined with features found in one or more other examples to achieve additional implementations. Accordingly, it will be understood that the examples shown in the accompanying drawings are provided for illustrative purposes only and they are not intended to limit the disclosure in any way. Like numbers refer to like elements throughout.

It will be understood that, although the terms first, second, third, etc. may be used herein to describe various elements, these elements should not be limited by these terms. These terms may be used to distinguish one element from another. For example, a first element may be termed a second element and a second element may be termed a first element without departing from the scope of the present invention. As used herein, the term "and/or" may include any and all combinations of one or more of the associated listed items.

It will be understood that when an element such as a layer, region, or substrate is referred to as being "on" or extending "onto" another element, it may be directly on or extend directly onto the other element or intervening elements may also be present. In contrast, when an element is referred to as being "directly on" or extending "directly onto" another element, there may be no intervening elements present. It will also be understood that when an element is referred to as being "connected" or "coupled" to another element, it may be directly connected or coupled to the other element and/or connected or coupled to the other element via one or more intervening elements. In contrast, when an element is referred to as being "directly connected" or "directly coupled" to another element, there are no intervening elements present between the element and the other element. It will be understood that these terms are intended to encompass different orientations of the element in addition to any orientation depicted in the figures.

Relative terms such as "below," "above," "upper,", "lower," "horizontal" or "vertical" may be used herein to describe a relationship of one element, layer, or region to another element, layer, or region as illustrated in the figures. It will be understood that these terms are intended to encompass different orientations of the device in addition to the orientation depicted in the figures.

Further, whether the LEDs, LED arrays, electrical components and/or electronic components are housed on one, two or more electronics boards may also depend on design constraints and/or application.

While LED strips have been incorporated in existing vehicular designs, mechanical integration of such LED strips in, for example, a vehicular body still remains an issue. However, a suitable mechanical integration of flexible LED strips is important, for example, for exact position referencing, for prevention of displacement of a mounted LED strip, and for maintaining a desired curved shape of the flexible LED strip.

Embodiments described herein may provide for a lighting device, for example a flexible LED strip, that may allow for improved mechanical integration into a mounting component, such as a part of a vehicle body or a lamp bezel, that may enable a more efficient production and that may enable an enhanced design freedom.

Figure 1B:
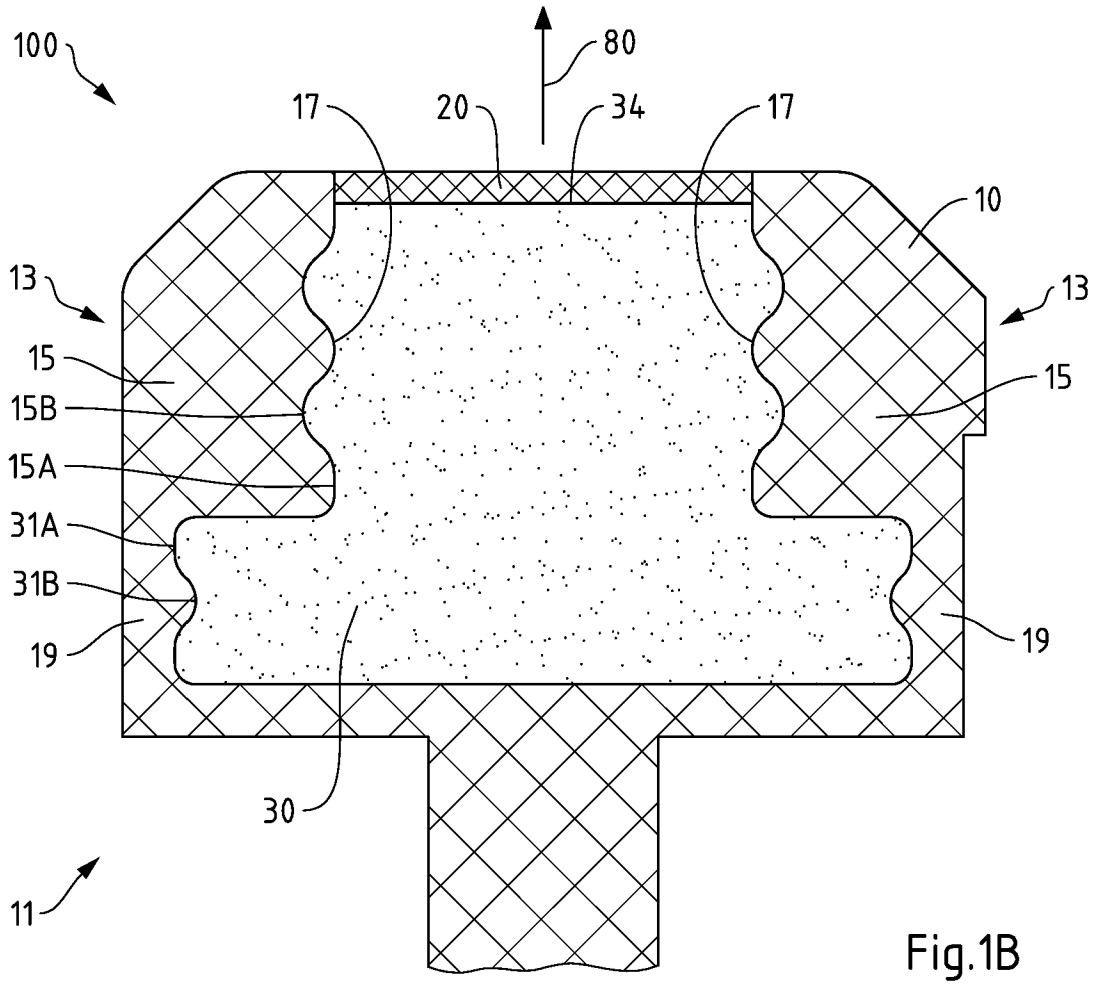
FIG. 1B is a cross-sectional view of the example LED lighting strip of FIG. 1A.

FIG. 1A is a perspective view of an example light emitting diode (LED) lighting strip 100. FIG. 1B is a cross-sectional view of the example LED lighting strip 100 of FIG. 1A. LED strip 100 may include a flexible housing 10, which may extend along a length direction 70. As visible in the cross-sectional view of FIG. 1B, the flexible housing may include a base portion 11 from which two side portions 13 may extend along a main lighting direction 80 of light emitting elements, which may be mounted to the base portion 11 but are not shown in the figures for conciseness purposes. The main lighting direction 80 may be, for example, a direction perpendicular to light emitting surfaces of LED dies mounted to the base portion 11.

As shown in FIG. 1B, the light guide 30 may include two locking protrusions 31 with respective locking features 31A, 31B. The locking protrusions 31 may respectively protrude into corresponding recessed sections 19 of the corresponding side portions 13 of the flexible housing 10 for firmly locking the light guide to the flexible housing 10. As shown, in an exemplary embodiment, the base portion 10 and the side portions 30 may at least partly surround the flexible light-guiding structure 30. In this exemplary embodiment, each of the two side portions 30 may include a locking element 15 with corresponding locking features 15A and 15B in engagement with a corresponding locking portion of the flexible light-guiding structure 30 for locking the flexible light-guiding structure 30 to the flexible housing 10.

In an exemplary embodiment, the light-guiding structure may extend along the length direction of the lighting device and may be arranged inside of the flexible housing. Thereby, the light-guiding structure may in particular be arranged on respective light emission portions of the at least two light emitting elements, for example on light emitting surfaces of LED dies, and may thus be arranged to receive, in particular, at least part of light emitted from the at least two light emitting elements. Thereby, the light-guiding structure may include at least one locking protrusion protruding into a corresponding recessed section of a corresponding one of the at least two side portions of the flexible housing for locking the light-guiding structure to the flexible housing. The light-guiding structure may thereby be firmly and tightly locked inside of the flexible housing, which may advantageously enhance optical coupling between the at least two light emitting elements and the light-guiding structure. Provision of the light-guiding structure may be advantageous in that on the one hand, the light-guiding structure may suitably guide light emitted from the at least two light-emitting elements, while, on the other hand, it may contribute to an advantageous stability of the lighting device. In an exemplary embodiment, the light-guiding structure may be or include a silicone light guide, which may be advantageous in terms of its light guiding properties and in terms of flexibility and stability.

LED strip 100 may further include an optical diffusor element 20 extending along the length direction 70 opposing respective light emission portions of LEDs, which are not shown in the figures. Optical diffusor element 20 may thus be arranged to receive light emitted from such LED mounted to the base portion 11. As shown, optical diffusor element 20 may be received by a gap formed by upper surface 34 of light guide 30 and the two side portions 13 of flexible housing 10.

In an exemplary embodiment, the lighting device may include at least one optical diffusor element extending along the length direction of the lighting device and opposing respective light emission portions of the at least two light emitting elements. Thereby, the at least one optical diffusor element may be arranged to receive light emitted from the at least two light emitting elements. In an exemplary embodiment, the at least one optical diffusor element may extend along at least 80% of the length, or along the entire length, of the lighting device. Thus, while the at least one optical diffusor element may extend along the entire length of the lighting device, it is similarly conceivable that, for example, end portions (for example conductor portions or the like) of the lighting device may extend beyond a length extension of the at least one optical diffusor element. Thereby, it is noted that extending along at least 80% of the length, in an exemplary embodiment, at least one portion of the at least one optical diffusor element may continuously extend along 80% of the length (or the entire length), or a sequence of individual diffusor elements may extend along 80% of the length (or the entire length).

In an exemplary embodiment, the at least one optical diffusor element may be made of or include transparent silicone with dispersed $TiO_2$ particles, such that light emitted from the at least two light emitting elements may be scattered and emitted from the lighting device as diffuse light. Thus, providing the at least one optical diffusor element may advantageously contribute to a desirable homogeneous illumination offered by the lighting device. In an exemplary embodiment, the at least one optical diffusor element may be received by a gap formed by an upper surface of the light guiding-structure on a side of the light guiding-structure facing away from the at least two light emitting elements and the two side portions of the flexible housing. This arrangement may be particularly advantageous as it may allow for a particularly stable construction and an advantageous optical coupling between the light guiding structure and the at least one optical diffusor element.

FIG. 1A further shows a mounting member 40, which may be formed as an integral component of the flexible housing 10, such that the mounting member 40 and the flexible housing 10 are one component. In the configuration of FIG. 1, mounting member 40 protrudes from the base portion 11 and extends along the length direction 70. Mounting member 40 may further protrude from base portion 11 in a direction opposing main lighting direction 80 (in a depth direction). As shown, in an exemplary embodiment (which may be taken in combination with one or more other embodiments described herein), the main lighting direction may essentially be perpendicular to the base portion of the flexible housing. As mentioned, such configuration of the mounting member 40 and the flexible housing 10 may be advantageous in particular for mounting the LED strip 100 to a lamp bezel (an example of a mounting component in accordance with an example embodiment). Thereby, in an exemplary embodiment of a lighting arrangement, the mounting component (e.g., the lamp bezel) may include a mounting recess. The mounting member may be integrally formed with the flexible housing protruding from the base portion in a direction opposing the main lighting direction and may be at least partially received by the mounting recess and removably or fixedly mounted to the mounting recess.

The at least one mounting member being an integral component of the flexible housing may be understood such that the at least one mounting member and the flexible housing are one component. In general, the flexible housing and the at least one mounting member may be produced by stamping and/or by extrusion. However, in an exemplary embodiment, the flexible housing and the at least one mounting member may be produced in a single step via extrusion. Extrusion may be particularly advantageous for producing an object of a fixed cross-sectional profile and may therefore be ideal for producing components of a flexible LED strip. Thereby, a material (e.g., silicone with dispersed $TiO_2$ particles) may be pushed through a die of the desired cross-section. This method may be advantageous in that complex cross-sections may be formed and an excellent surface finish can be achieved.

By providing the mounting member as an integral component of the flexible housing, additional parts for mounting the lighting device to a mounting component, such as a vehicle body, for example holders or the like, may no longer be required. Mounting the lighting device may thus be facilitated while, at the same time, mounting precision and stability may be improved. Further, additional necessary steps for mounting a lighting device first to a separate holder before mounting the corresponding assembly to a car body can be avoided, as well as additional production steps for producing such holder. Still further, space that in conventional designs relying on dedicated holders has to be saved for such holder can in case of a lighting device according to embodiments described herein be advantageously used for the lighting device. In other words, a lighting device according to embodiments described herein may be particularly efficient in terms of space requirements, and a particularly small dimension of an LED strip with one or more necessary mounting members can be achieved.

It is noted that the at least one mounting member may serve both for alignment of the lighting device with respect to, for example, a vehicle body part or with respect to a lamp bezel as well as for fixing (removably or fixedly) the lighting device to the vehicle body part or the lamp bezel. Thus, in the case of a lighting device according to the first aspect, alignment features and fixation points may be an integral components of the flexible housing of the lighting device in form of the at least one mounting member. By providing the at least one mounting member as an integral component of the flexible housing, for example holders, which may have to be specifically designed for a given vehicle body part, can be avoided. Contrarily, a lighting device according to embodiments described herein may be advantageously produced to be compatible, for example, with various differently shaped vehicle body parts or lamp bezels. In an exemplary embodiment, the flexible housing and the at least one mounting member can be integrally formed in a not complex manner, such as by extrusion and/or stamping.

In an exemplary embodiment, the at least one mounting member and the flexible housing may be formed from a common flexible material. In other words, in an exemplary embodiment, the flexible housing and the at least one mounting member may include or be formed of a silicone host matrix, which may further include inorganic particles, such as $TiO_2$ particles. It is noted that use of a material of the silicone family (e.g., methyl and/or phenyl based members of the silicone family) for the host matrix may be advantageous in particular in terms of thermal stability. Thus, using a silicone as host matrix material may enable advantageous flexibility and stability of the lighting device. The inorganic particles, such as the $TiO_2$ particles, may advantageously enable the above-mentioned light scattering and thus a diffuse reflection of light emitted from the at least two light emitting elements. Thereby, while different inorganic materials, such as $Al_2O_3$ or $ZrO_2$, may be used as particle material, $TiO_2$ (which may include any family member such as its rutile and/or anatase variants) may be an advantageous choice in terms of reflectivity performance.

As mentioned above, the flexible housing of the lighting device may extend in the length direction, which, in an exemplary embodiment, is a direction along the longest extension of the lighting device. Thereby, in an exemplary embodiment in which the lighting device is a flexible light emitting diode (LED) strip, the length direction may be the direction along the strip. In other words, as, for example, such flexible LED strip may be bendable and can be mounted, for example, to a car body part or a lamp bezel in a bent and/or a curved configuration, the length direction may correspond to a curved or bent path following the longest extension of the lighting device.

In an exemplary embodiment, the flexible housing may extend along at least 80% of the length, in particular along the entire length, of the lighting device. Thus, while the flexible housing may extend along the entire length of the lighting device, it is similarly conceivable that, for example, end portions (for example conductor portions or the like) of the lighting device may extend beyond a length extension of the flexible housing. Thereby, it is noted that extending along at least 80% of the length, in an exemplary embodiment, at least one portion of the flexible housing may continuously extend along 80% of the length (or the entire length), or a sequence of individual flexible housing portions may extend along 80% of the length (or the entire length).

As shown in FIG. 1A, mounting member 40 includes mounting features 43 in the form of through holes for receiving corresponding screws when mounting the LED strip 100 to a corresponding mounting component. The mounting features 43 may be provided on respective mounting sections 41, which may be mutually separated by recesses 45 that extend from a base section 42 and are open on one side. As explained above, recesses 45 may be particularly advantageous as they may suitably allow for bending of the LED strip 100, and, in case of FIG. 1, particularly within a plane of the mounting member 40 when mounting the LED strip 100 to a curved portion (e.g., of a Lamp bezel).

In an exemplary embodiment, the recess separating the at least two mounting sections may be open on one side and extend in a direction essentially perpendicular to the length direction of the lighting device. Further, in an exemplary embodiment, the recess separating the at least two mounting sections may extend from the base section of the at least one mounting member.

Such recess may be particularly advantageous in that it may facilitate bending of the lighting device. For example, in a case in which the at least one mounting member extends from the flexible housing in at least one corresponding lateral direction (with respect to the main lighting direction of the at least two light emitting elements), the recess facilitates bending of the lighting device in a plane comprising the lateral direction. Similarly, in a case in which the at least one mounting member extends from the flexible housing in a direction opposing the main lighting direction of the at least two light emitting elements, the recess may facilitates bending of the lighting device in a plane that includes the main lighting direction.

In an exemplary embodiment, the at least one mounting member may include at least two neighboring mounting sections, for example fixing lugs, each one of the at least two mounting sections may be provided with at least one mounting feature for mounting the lighting device, and the at least two mounting sections may be mutually separated by a recess. Thus, in an exemplary embodiment, the at least one mounting member may comprise a sequence of mounting sections, each mounting section protruding from the flexible housing, the sequence extending along the length direction of the lighting device, wherein each two mounting sections of respective pairs of mounting sections are separated by a corresponding recess. In a further exemplary embodiment, the sequence of mounting sections may extend along at least 80% of the length, for example the entire length, of the lighting device. In this exemplary embodiment, the sequence of mounting sections may extend from a base section of the at least one mounting member, which may extend continuously along at least 80% of the length, for example the entire length, of the lighting device.

As further shown in FIG. 1A, mounting member 40 further comprises cut-outs 47 respectively arranged in between the corresponding mounting feature 43 and the flexible housing 10. As mentioned, such cut-outs 43 may advantageously enable thermal expansion and contraction (e.g., of flexible housing 10 and base section 42) due to operation and non-operation of LEDs of LED strip 100 while mounting sections 41 are fixed to a mounting component. A risk of damage caused by such thermal expansion and contraction may thus be greatly reduced.

In an exemplary embodiment, the at least one mounting member extends along at least 80% of the length, and in some embodiments along the entire length, of the lighting device. Thus, while the at least one mounting member may extend along the entire length of the lighting device, it is similarly conceivable that, for example, end portions (for example conductor portions or the like) of the lighting device may extend beyond a length extension of the at least one mounting member. Thereby, it is noted that extending along at least 80% of the length, in an exemplary embodiment, at least one portion of the at least one mounting member may continuously extend along 80% of the length (or the entire length), or a sequence of individual mounting members may extend along 80% of the length (or the entire length).

In an exemplary embodiment, the at least one mounting member comprises an elongated cross-section protruding outwardly from an outer surface of the flexible housing and extends along the length direction of the lighting device. For example, the at least one mounting member may comprise an essentially rectangular cross-section protruding outwardly from an outer surface of the flexible housing. Thereby, "essentially" may be understood as covering typical fabrication tolerances that may lead to an imperfect rectangular shape. In this case, in an exemplary embodiment, an aspect ratio (a ratio of the longer side to the shorter side) of the essentially rectangular cross-section may be between 1 to 20 in some embodiments, between 5 to 15 in some embodiments, and between 8 to 13 in some embodiments. In other words, in an exemplary embodiment, the at least one mounting member may be an essentially flat member protruding from a face of the flexible housing and extending along the length direction of the lighting device.

While it is noted that the at least one mounting member may be connected to a corresponding mounting portion of a mounting component, such as by gluing, in an exemplary embodiment, the at least one mounting feature may be an opening for receiving a screw. While different mounting features may be employed, such opening may be advantageous in that mounting using screws may enable use of corresponding washers, which in turn may allow for suitably adjusting a mounting force to the thickness and flexibility of the at least one mounting member.

In an exemplary embodiment, the lighting device further comprises at least one mounting feature for mounting the lighting device and at least one corresponding cut-out arranged in between the at least one mounting feature and the flexible housing. Such cut-out (e.g., an opening, an elongated opening, a recess, or a through hole) may be particularly advantageous as it may allow the flexible housing to expand in reaction to heat generated by the at least two light emitting elements in operation and to contract thereafter while at the same time reducing the risk of damage to the at least one mounting feature caused by such thermal expansion and contraction.

In an exemplary embodiment, each of the at least two light emitting elements comprises or corresponds to a light emitting element (LED), such as an LED die. The at least two light emitting elements may be arranged along the length direction of the lighting device and may, in an exemplary embodiment, thus from a longitudinal arrangement of LEDs along the length direction (e.g., one or more lines or stripes of LEDs placed beside each other along the length direction).

In an exemplary embodiment, each of the at least two light emitting elements comprises or is a light emitting diode (LED). Thereby, the lighting device may be a flexible LED strip.

The light emitting elements may be directly or indirectly mounted to the flexible housing. In an exemplary embodiment, the at least two light emitting elements may be mounted inside of the flexible housing onto an inner mounting surface of a base portion of the flexible housing. The inner surface of the flexible housing that is configured to reflect light emitted from the at least two light emitting elements may, in an exemplary embodiment, correspond to at least one inner surface of at least one corresponding side portion of the flexible housing extending from the base portion. The at least one side portion may extend, in an exemplary embodiment, along a main lighting direction of the at least two light emitting elements, whereby, in case that the at least two light emitting elements each correspond to an LED die, the main lighting direction may essentially be perpendicular to a light emitting surface of the LED die (e.g., a surface at which light exits from the LED die). While, for certain applications, the inner surface of the flexible housing may be configured to cause a specular reflection of light emitted from the at least two light emitting elements, in an exemplary embodiment, the inner surface of the flexible housing may be configured to cause a diffuse reflection of the light emitted from the at least two light emitting elements. Thereby, diffuse reflection may be understood as a reflection of light from the inner surface such that light incident on the inner surface is scattered at many angles rather than at just one angle as in the case of the specular reflection. In this way, the inner surface may advantageously contribute to a desirable homogeneous light distribution emitted from the lighting device. As explained further herein, in an exemplary embodiment, at least part of the inner surface may form a mixing box for light emitted from the at least two light emitting elements. In particular, in this embodiment, it may be advantageous to provide the inner surface (e.g., the respective inner surfaces of the side portions of the flexible housing described further herein) configured for diffuse reflection as improved performance in terms of light output and homogeneity can be achieved.

In an exemplary embodiment, the inner surface may include at least respective inner surfaces of the side portions of the flexible housing such that the flexible housing forms a mixing box for light emitted from the at least two light emitting elements. Such mixing box may advantageously guide light emitted from the at least two light emitting elements along the main lighting direction and thus advantageously enhance efficiency of the lighting device. In other words, by providing the mixing box, light rays emitted from the at least two light emitting elements that may otherwise be absorbed by the side portions may have a strongly increased probability to eventually exit the lighting device, potentially after plural reflections within the mixing box.

In an exemplary embodiment, the at least one mounting member is configured for mounting the lighting device to a part of a vehicle body, vehicle body part and/or lamp bezel. To this end, the at least one mounting member may be provided in a suitable shape, in a suitable dimension and/or from a suitable (e.g., sufficiently strong) material.

In an exemplary embodiment, a lighting arrangement may be provided that includes a mounting component and the lighting device, as described above. Thereby, the at least one mounting member may be removably or fixedly mounted to a corresponding portion of the mounting component. In an exemplary embodiment, the mounting component may be a part of a vehicle body (e.g., a vehicle body part), a part of a lamp bezel, or a part of a vehicle grill, whereby, in an exemplary embodiment, the vehicle body part may be a part of a body of a car, a motorcycle, a water vehicle such as a vessel, boat, yacht, or air plane. A lighting arrangement, where the mounting component is a car grill, such as a front grill, may be advantageous in that the flexible LED strip mounted to the front grill may help to increase the crush-collapsible zone and may thus help protect passengers in case of an accident.

Figure 2A:
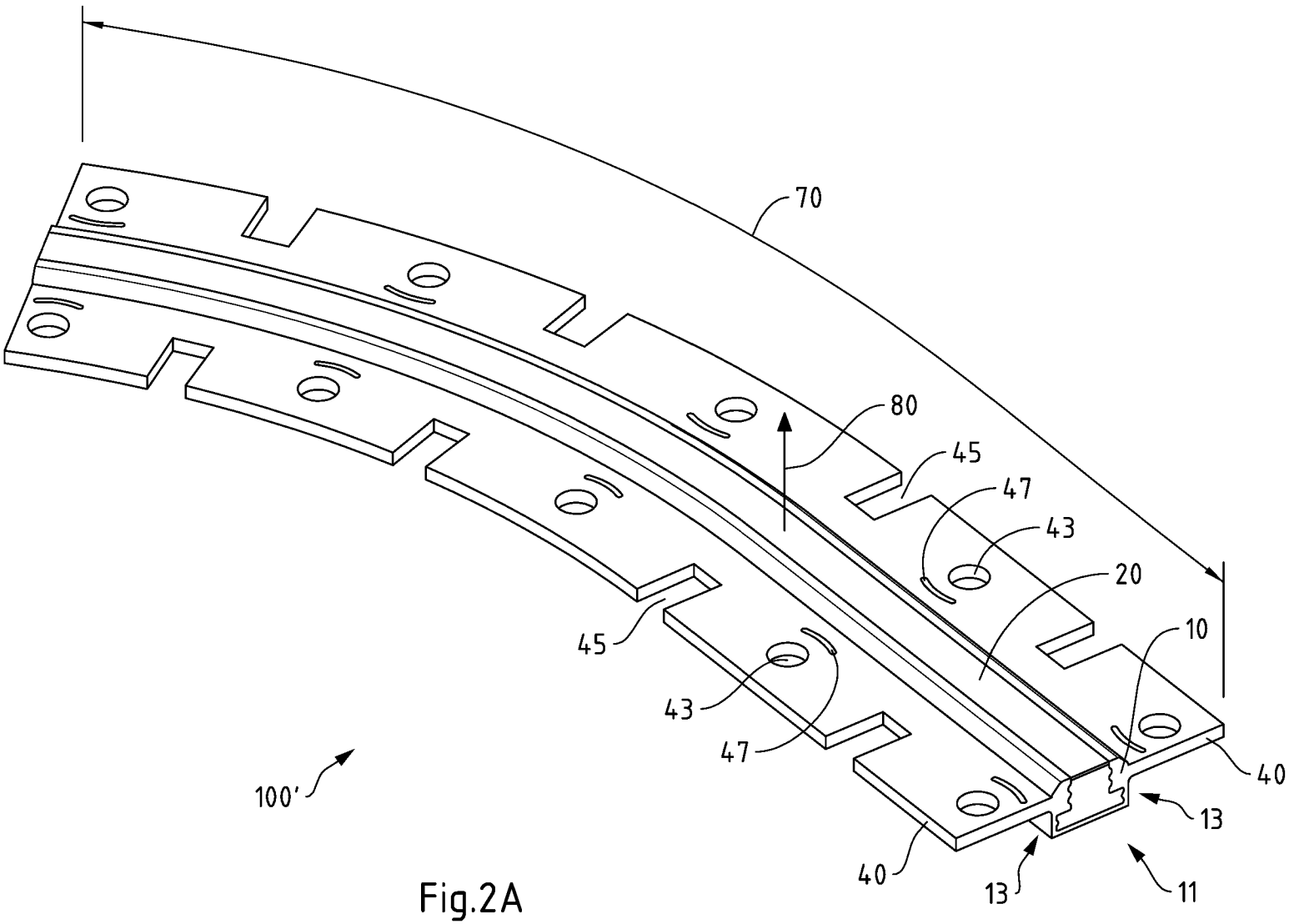
FIGS. 2A to 2C are perspective views of a further embodiment of an LED strip according to an exemplary embodiment.
Figure 2B:
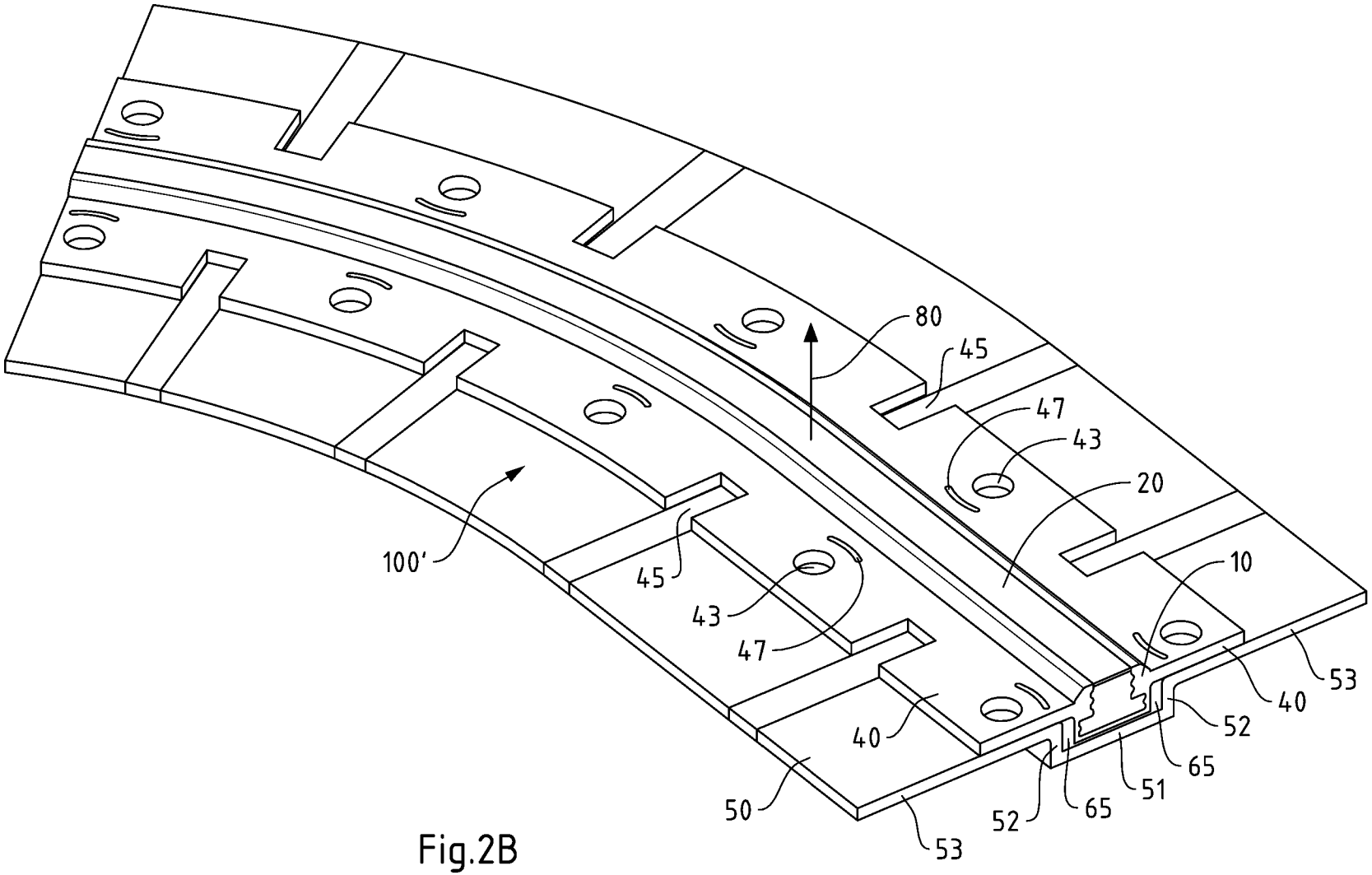
Figure 2C:
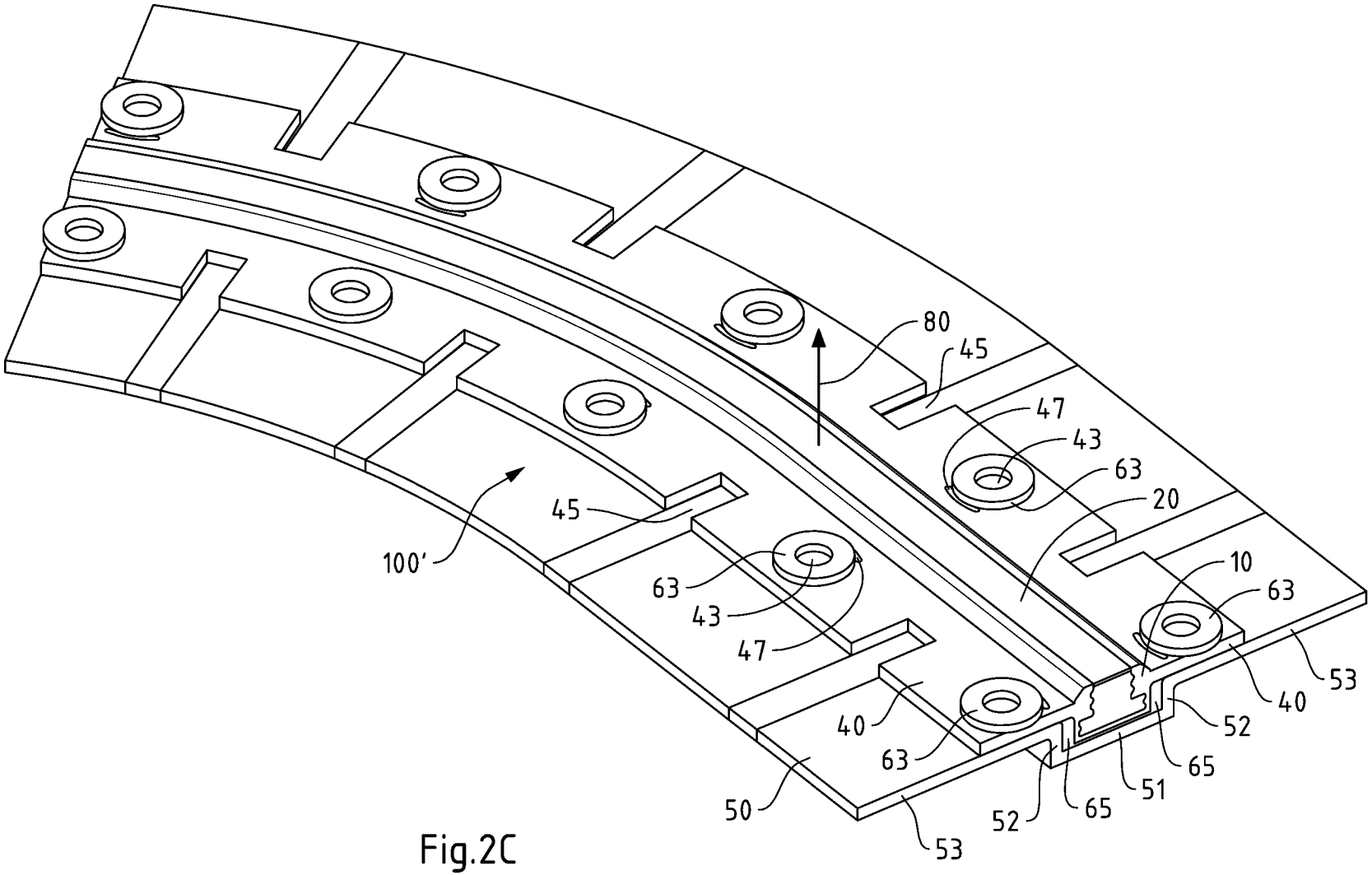

FIGS. 2A to 2C are perspective views of a further embodiment of an LED strip 100' according to an exemplary embodiment. It may be noted that flexible housing 10, optical diffusor element 20 and light guide 30 of FIGS. 2A to 2C correspond to flexible housing 10, optical diffusor element 20 and light guide 30 of FIGS. 1A and 1B. As shown in FIGS. 2A to 2C, in case of LED strip 100', two mounting members 40 (each one corresponding to mounting member 40 of FIGS. 1A and 1B), may protrude from opposing side portions 13 of flexible housing 10 and extend along the length direction of LED strip 100'. Thereby, mounting members 40 may protrude from the respective side portions 13 in directions essentially perpendicular to main lighting direction 80 (laterally).

As mentioned, this configuration of mounting members 40 and flexible housing 10 may be particularly advantageous for mounting LED strip 100' to a vehicle body part 50 as shown in FIGS. 2B and 2C. The vehicle body part may, for example, correspond to a portion of a car body positioned such that the LED strip 100' may be employed for interior or exterior illumination of a car. As can be taken from FIGS. 2B and 2C, vehicle body part 50 may include a longitudinal mounting channel 51 and two mounting shoulders 53 respectively arranged on corresponding sides of the longitudinal mounting channel 51 adjacent to the longitudinal mounting channel. Each mounting member 40 may be arranged in contact with a corresponding mounting shoulder to be mounted to vehicle body part 50 (e.g., using screws to be received by mounting features 43). As shown in FIG. 2C, washers 63 may be used in combination with the screws to suitably distribute a mounting force of the screws and thereby adjust the mounting force to the material and geometry of the mounting members 40. As can be further be taken from FIGS. 2B and 2C, recesses 45 may advantageously facilitate bending of the flexible LED strip 100' in particular within a plane of the mounting members in accordance with a shape of the vehicle body part 50.

In some embodiments, the at least one mounting member may protrude from the base portion and extend along the length direction of the lighting device and/or the at least one mounting member may protrude from at least one of the two side portions and extend along the length direction of the lighting device. Thereby, in an exemplary embodiment, the at least one mounting member may protrude from the base portion in a direction opposing a main lighting direction of the lighting device (in a depth direction) and/or protrude from at least one of the two side portions in a direction essentially perpendicular to a main lighting direction of the lighting device (laterally).

The case in which the at least one mounting member extends in a depth direction may be particularly advantageous for mounting the lighting device to a lamp bezel, in which case space is often limited along a lateral direction. In this case, the lamp bezel may, for example, be provided with a suitable (e.g., elongated) mounting recess for receiving the at least one mounting member for mounting the lighting device to the lamp bezel. The case where the at least one mounting member protrudes horizontally may be particularly advantageous, for example in case that the lighting device is to be mounted to a vehicle body part. In this case, the flexible housing may, for example, be received at least partially within a mounting channel of the vehicle body part, while the at least one mounting member may suitably be mounted to a mounting shoulder adjacent to the mounting channel. By receiving the at least one mounting member at least partially by the mounting recess of the lamp bezel, and by receiving at least part of the flexible housing by the mounting channel of the vehicle body part, a particularly beneficial stability and mounting precision may be achieved.

FIGS. 2B and 2C further illustrate that flexible housing 10 of LED strip 100' may be partially received by mounting channel 51. As shown, in an exemplary embodiment, a gap 65 may be arranged at least in between one side portion 13 of the flexible housing 10 and a corresponding side wall 52 of the longitudinal mounting channel 52 and/or in between the base portion 11 of the flexible housing 10 and a corresponding face of the longitudinal mounting channel 51. As mentioned above, such configuration of the flexible LED strip 100' and the vehicle body part 50 may allow for a beneficial stability and mounting precision to be achieved. At the same time, providing the gap 65 (e.g., an air gap) may allow for thermal expansion of the flexible housing upon operation of the LEDs, thereby reducing a risk of damage. In addition, such gap may advantageously help to compensate for different indices of thermal expansion of the LED strip 100' and the vehicle body part 50.

A thickness of the mounting members 40 may be a suitable parameter for defining a stiffness of the portion connecting the vehicle body part and the flexible LED strip 100'. This thickness may thus be suitably adjusted (e.g., to increase the stiffness of the part connecting the vehicle body part to the flexible LED strip 100') and to reduce, for example, an impact of vibration upon later operation.

Figure 3:
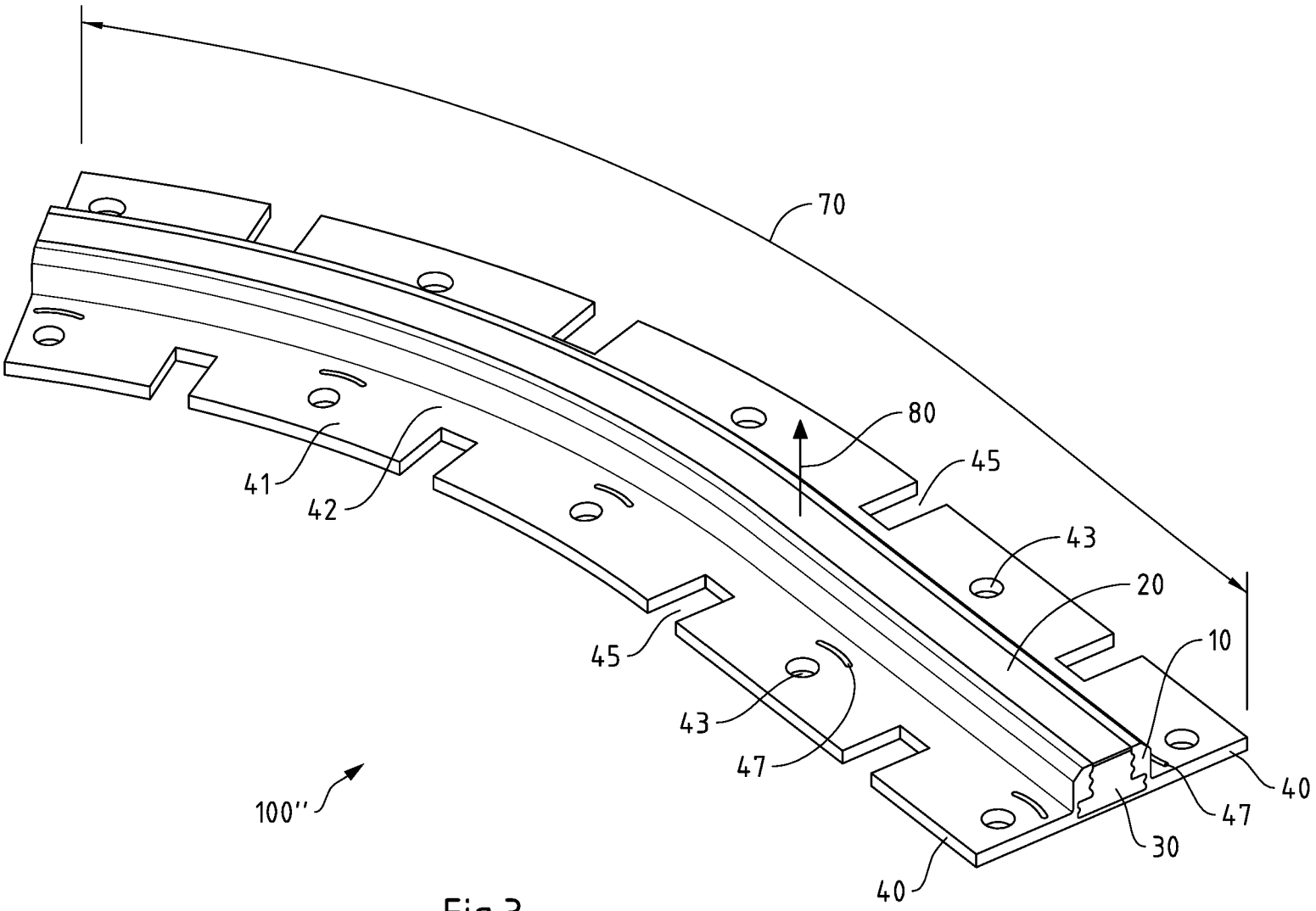
FIG. 3 is a perspective view of a further embodiment of an LED strip.

FIG. 3 is a perspective view of a further embodiment of an LED strip 100". While in case of LED strip 100' illustrated in FIGS. 2A to 2C, the mounting members 40 protrude from a distal end of side portions 13, in FIG. 3, mounting members 40 of LED strip 100" protrude from a portion of the side portions 13 adjacent to base portion 11. This configuration may allow for an alternative mounting configuration with respect to a mounting component according to which the flexible housing may, for example, be fully received by a corresponding mounting channel of the mounting component, which may be open for light to be emitted from the LED strip 100". Such configuration may provide advantages in terms of stability, mounting precision and stability. An additional advantage of this configuration may be that a light emitting area (e.g., the optical diffusor element 20) of flexible LED strip 100" may be at the same vertical level as the car body part and, for example, heads of screws used for mounting LED strip 100" may be hidden.

Figure 4:
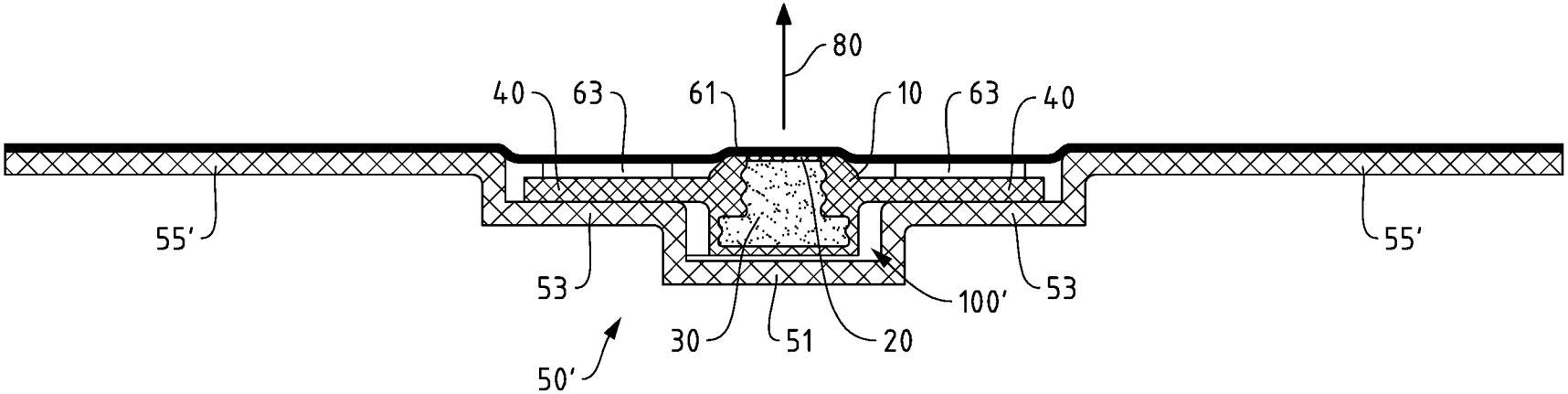
FIG. 4 is a cross-sectional view of a further embodiment of a vehicle body part.

FIG. 4 is a cross-sectional view of a further embodiment of a vehicle body part 50', which, in addition to the components of body part 50 shown in FIGS. 2B and 2C, may include a sealing shoulder 55', which may extend from mounting shoulder 53 and allow for mounting of a sealing member 61. Sealing member 61 may correspond to or include, for example, a transparent protective foil, a plastic member or a glass member in combination with suitable sealing parts. The transparent protective foil 61 may be laminated or glued on the car body part 50'.

Figure 5:
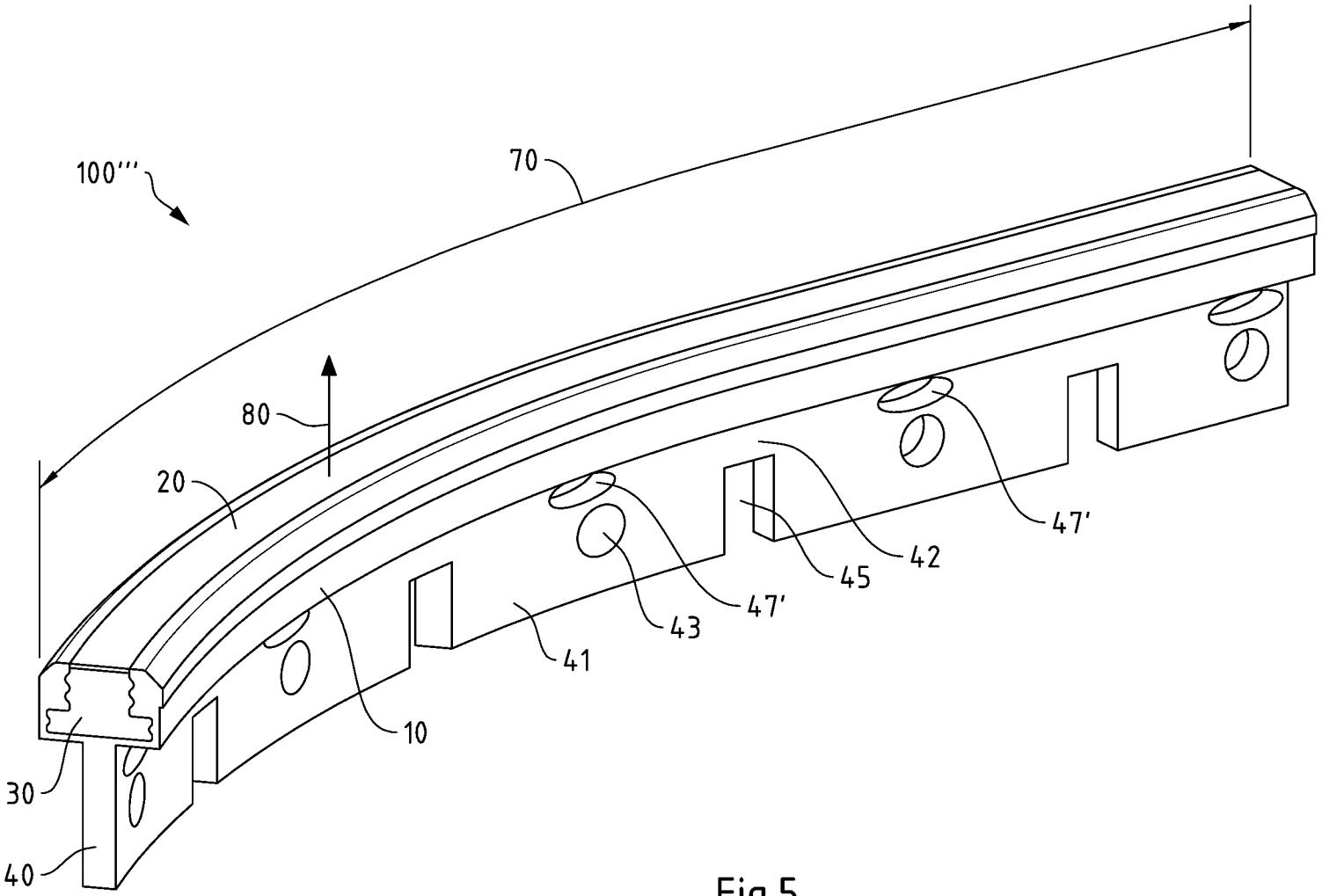
FIG. 5 is a perspective view of a further exemplary embodiment of LED strip.

FIG. 5 is a perspective view of a further exemplary embodiment of LED strip 100'" according to a further exemplary embodiment. As compared, for example, to LED strip 100 of FIG. 1A, LED strip 100'" may include cut-outs 47' of larger size and different shape. While cut-outs 47 of LED strip 100 shown in FIG. 1 may be advantageous for cases where a small total size of the product is desirable, cut-outs 47' may be advantageous as they may even further support release of thermal stress and may even further support bending of LED strip 100'". For example, an oval or elliptical cross-section with a strong aspect ratio may enable tuning such properties of LED strip 100'".

Figure 6:
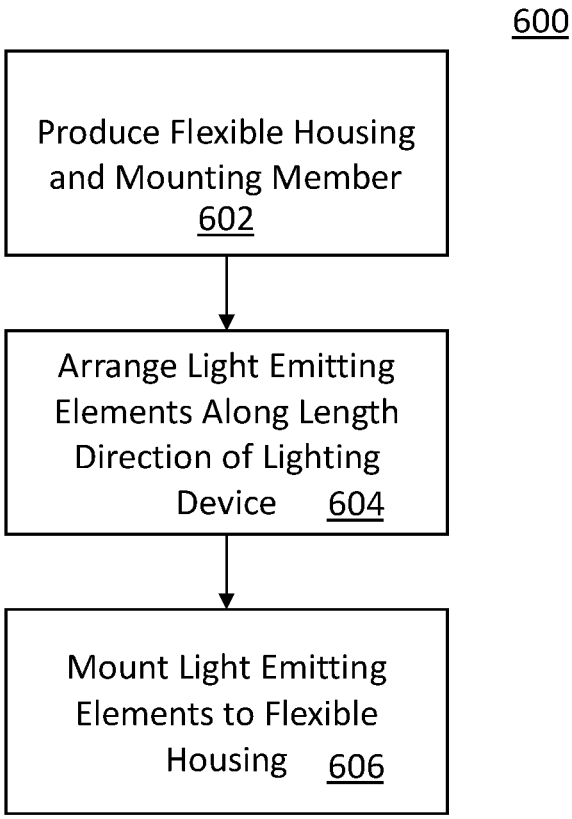
FIG. 6 is a flow diagram of an example method of manufacturing a lighting device.

FIG. 6 is a flow diagram 600 of a method of manufacturing a lighting device. In the example illustrated in FIG. 6, a flexible housing and at least mounting member are produced (602). In embodiments, the mounting member may be one or more mounting members and may be an integral component of the flexible housing. The flexible housing may extend along a length direction of the lighting device and have an inner surface that reflects light emitted from one or more light emitting elements. The at least one mounting member may include a base section and a sequence of mounting sections. The sequence of mounting sections may extend from the base section of the at least one mounting member, and at least two mounting sections may be mutually separated by a recess. The light emitting elements may be arranged along the length direction of the lighting device (604). The light emitting elements may be mounted to the flexible housing (606).

Having described the embodiments in detail, those skilled in the art will appreciate that, given the present description, modifications may be made to the embodiments described herein without departing from the spirit of the inventive concept. Therefore, it is not intended that the scope of the invention be limited to the specific embodiments illustrated and described.

What is claimed is:

1. A lighting device comprising:

a housing formed from a flexible material and extending along a length direction of the lighting device, the length direction being longer than a width direction of the lighting device, the housing comprising:

an inner surface configured to reflect light, and at least one mounting member that is formed from the flexible material, is an integral component of the housing, and extends continuously along the length direction of the lighting device, the at least one mounting member comprising a single base section and a sequence of mounting sections that extend from the single base section, each of the mounting sections in the sequence being separated from a neighboring one of the mounting sections in the length direction by a recess, the mounting sections being configured for mounting the lighting device to an external mounting component; and at least two light emitting elements arranged along the length direction of the lighting device and mounted to the housing.

2. The lighting device according to claim 1, wherein the at least one mounting member is for mounting the lighting device.

3. The lighting device according to claim 1, wherein the at least one mounting member and the housing are formed from a common flexible material.

4. The lighting device according to claim 1, wherein the at least one mounting member comprises an elongated cross-section protruding outwardly from an outer surface of the housing and extends along the length direction of the lighting device.

5. The lighting device according to claim 1, wherein the at least one mounting member extends along at least 80% of the length of the lighting device in the length direction.

6. The lighting device according to claim 1, wherein the at least one mounting member comprises at least two neighboring mounting sections, each one of the at least two mounting sections being provided with at least one mounting feature for mounting the lighting device, and the at least two mounting sections being mutually separated by the recess.

7. The lighting device according to claim 1, further comprising at least one mounting feature for mounting the lighting device and at least one corresponding cut-out arranged in between the at least one mounting feature and the housing.

8. The lighting device according to claim 1, wherein:

the housing comprises a base portion and two mutually opposing side portions respectively extending from the base portion, the at least two light emitting elements are mounted on the base portion, at least one of the at least one mounting member protrudes from the base portion and extends along the length direction of the lighting device or the at least one mounting member protrudes from at least one of the two side portions and extends along the length direction of the lighting device.

9. The lighting device according to claim 8, further comprising a flexible light-guiding structure that extends along the length direction of the lighting device and is arranged inside of the housing, the light-guiding structure comprising at least one locking protrusion protruding into a corresponding recessed section of a corresponding one of the at least two side portions of the housing for locking the light-guiding structure to the housing.

10. The lighting device according to any of claim 8, wherein the inner surface comprises at least respective inner surfaces of the side portions such that the housing forms a mixing box for light emitted from the at least two light emitting elements.

11. The lighting device according to claim 1, further comprising at least one optical diffusor element extending along the length direction of the lighting device and opposing respective light emission portions of the at least two light emitting elements.

12. The lighting device according to claim 1, wherein each of the at least two light emitting elements comprises a light emitting diode (LED) and the lighting device is a flexible LED strip.

13. The lighting device according to claim 1, wherein each of the at least two light emitting elements is a light emitting diode (LED) and the lighting device is a flexible LED strip.

14. A lighting arrangement comprising:

a mounting component; and a lighting device, the lighting device comprising:

a housing formed from a flexible material and extending along a length direction of the lighting device, the length direction being longer than a width direction of the lighting device, the housing comprising:

an inner surface configured to reflect light, and at least one mounting member that is formed from the flexible material, is an integral component of the flexible housing, and extends continuously along the length direction of the lighting device, the at least one mounting member comprising a single base section and a sequence of mounting sections that extend from the single base section, each of the mounting sections in the sequence being separated from a neighboring one of the mounting sections in the length direction by a recess and the at least one mounting member being removably or fixedly mounted to a corresponding portion of the mounting component; and at least two light emitting elements arranged along the length direction of the base section.

15. The lighting arrangement according to claim 14, wherein:

the mounting component comprises a longitudinal mounting channel and two mounting shoulders respectively arranged on corresponding sides of the longitudinal mounting channel adjacent to the longitudinal mounting channel, the lighting device comprises at least two mounting members integrally formed with the housing and protruding from respective ones of the two opposing side portions of the housing, each of the at least two mounting members being removably or fixedly mounted to a corresponding one of the two mounting shoulders of the mounting component, and the housing is at least partially received by the mounting channel.

16. The lighting arrangement according to claim 14, wherein:

the mounting component comprises a mounting recess, and the lighting device further comprises a mounting member integrally formed with the housing and protruding from the base portion of the housing, the mounting member being received at least partially by the mounting recess and removably or fixedly mounted to the mounting recess.

17. A method of manufacturing a lighting device comprising:

producing a housing and at least one mounting member as an integral component of the flexible housing from a flexible material, the housing extending along a length direction of the lighting device, the length direction being longer than a width direction of the lighting device, and having an inner surface configured to reflect light emitted from the at least two light emitting elements, and the at least one mounting member comprising a single base section and a sequence of mounting sections that extend from the single base section, and each of the mounting sections in the sequence being mutually separated from a neighboring one of the mounting sections in the length direction by a recess;

mounting at least two light emitting elements along the length direction of the single base section; and fixedly mounting the sequence of mounting sections to a corresponding portion of an external mounting component.

* * * * *